US005721685A

United States Patent [19]

Holland et al.

[11] Patent Number: 5,721,685

[45] Date of Patent: Feb. 24, 1998

[54] DIGI-TRACK DIGITAL ROADWAY AND RAILWAY ANALYZER

[76] Inventors: Robert E. Holland, 2021 Art Museum Dr. #140, Jacksonville, Fla. 32207; Terry S. Brown, 1216 Cedar Tree La., Tampa, Fla. 33584; Roy T. Flowers, Jr., 5035 Nola Ct., Jacksonville, Fla. 32210

[21] Appl. No.: 496,541

[22] Filed: Jun. 29, 1995

[51] Int. Cl.[6] ..... G01B 11/30; E01C 19/00

[52] U.S. Cl. ..... 364/449.1; 364/449.7; 364/449.9; 364/424.07; 342/357; 342/451; 404/84.1; 404/84.05

[58] Field of Search ..... 364/449.1, 450, 364/550, 560, 561, 424.07, 449.7, 449.9, 453, 557, 436; 340/990, 995, 937; 342/357, 451; 404/84.1, 93, 84.2, 84.05, 84.5, 96

[56] References Cited

U.S. PATENT DOCUMENTS

| | | | |
|---|---|---|---|
| 4,700,223 | 10/1987 | Shoutaro | 348/148 |
| 4,899,296 | 2/1990 | Khattak | 364/550 |
| 5,075,772 | 12/1991 | Gebel | 348/135 |
| 5,214,757 | 5/1993 | Mauney et al. | 340/990 |
| 5,323,647 | 6/1994 | Blanco | 73/146 |
| 5,364,205 | 11/1994 | Lemelson | 404/72 |
| 5,517,419 | 5/1996 | Lackton et al. | 364/449 |
| 5,549,412 | 8/1996 | Malone | 404/84.1 |

*Primary Examiner*—Tan Q. Nguyen

[57] ABSTRACT

A horizontal position and vertical elevation measurement apparatus and method for measuring horizontal positioning and absolute elevations of railways, paved or unpaved roadways, and other travel surfaces. The apparatus is capable of determining longitudinal and transverse elevational profiles in an X-Y-Z coordinate format usable with Geographical Information Systems (GIS) and Land Information Systems (LIS) to project present and future traffic counts and traffic flow patterns. It can measure the horizontal location and elevations of paved and unpaved travel surfaces, potholes, cracks, wheel ruts, etc. within a travel surface, and the horizontal location and elevations of railway tracks when conventional railroad high rail gear is used. The apparatus has Global Positioning System (GPS) signal receiving units fixed to each end of a sensor bar mounted on a vehicle perpendicular to vehicle movement. Depending upon the type of surface is being located, the sensor bar has a combination of non-mechanical sonic or infrared distance sensors placed across the sensor bar between the GPS signal receiving units which gather vertical elevation information. Concurrent with collection of information from the GPS units and the distance sensors, a video camera projects downward at the travel surface and provides a visual reference of the surface conditions should collected data exceed preset ranges. Measurement intervals are user defined. Raw digital data is stored in an onboard computer system. The data is later transferred to a remote computer for post processing, analysis and generation of the final formatted electronic file by proprietary and copyrighted software.

19 Claims, 1 Drawing Sheet

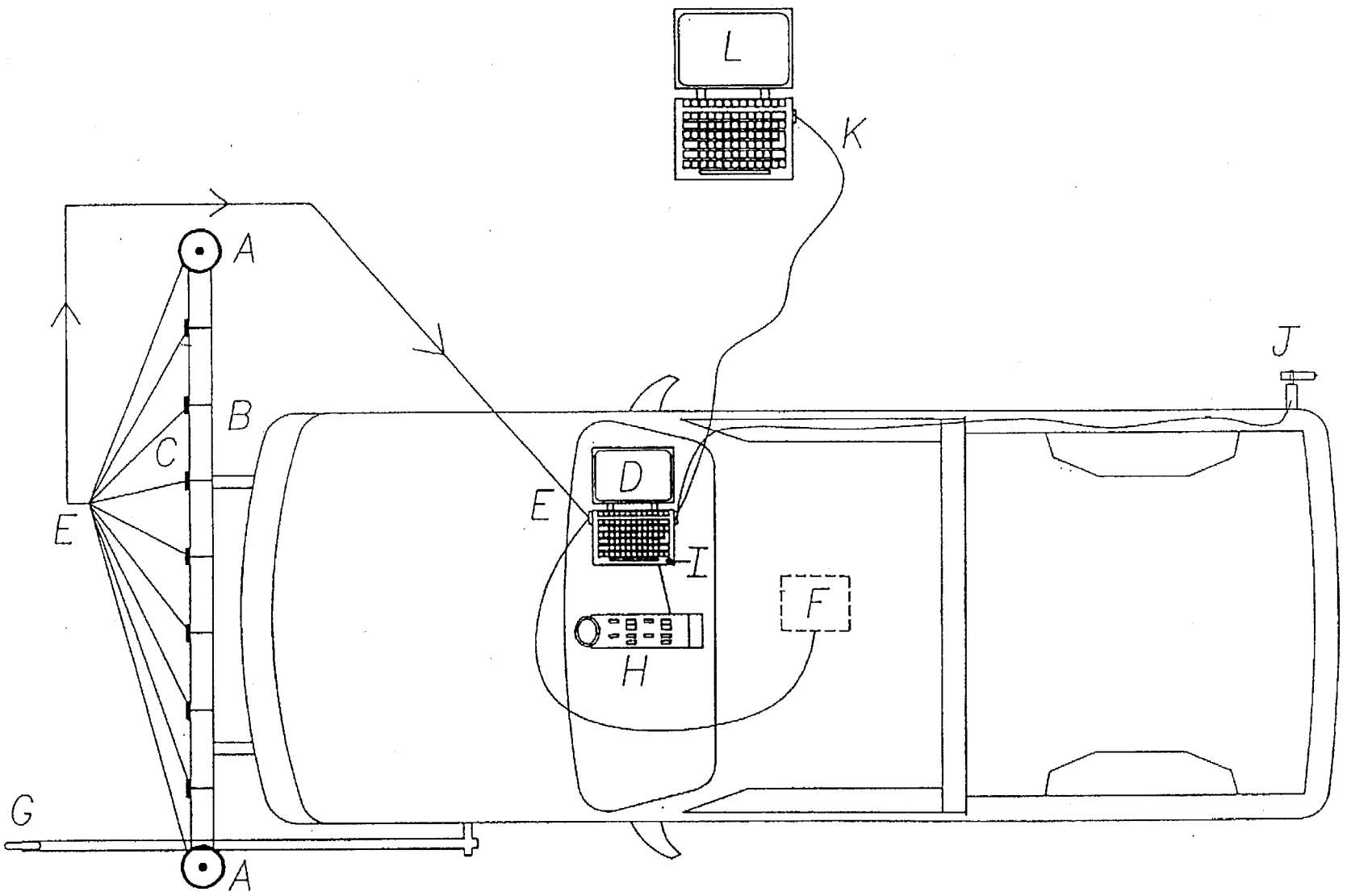
J
K
L
F
I
D
H
E
A
B
C
E
A
G

DIGI-TRACK DIGITAL ROADWAY AND RAILWAY ANALYZER

BACKGROUND—FIELD OF INVENTION

This invention relates to roadway and railway surface track inspecting and testing apparatus, specifically to mobile apparatus using Global Positioning System signal receiving units and non-mechanical distance sensors to measure horizontal positioning and absolute elevations of roadway and railway surfaces and computer means for translating collected data into formats usable with Geographical Informaiton Systems (GIS) and Land Information Systems (LIS) for the projection of present and future traffic counts and traffic flow patterns. In the above context, roadway is broadly defined to include paved roads, unpaved roads, interstate highways, airport runways and other similar travel surfaces.

BACKGROUND—DESCRIPTION OF PRIOR ART

Paved roadways, airport runways, unpaved roadways and railway tracks are the transportation corridors for the vast majority of the commercial and industrial land-based shipping traffic throughout the world. Prolonged traffic loads imposed daily upon these transportation corridors, by the wheels of transportation vehicles, subject the roadway and railway surfaces to varying rates of physical deterioration. Managing the serviceability of this infrastructure requires accurate measurement of the elevations and surface condition of the roadways and railways. Prior to implementation of an effective maintenance and reconstruction program for a transportation corridor, those responsible for its maintenance must conduct periodic surveys on the roadway and railway surfaces to determine existing conditions. Through a comparison of current survey data to prior data, the rate of deterioration of roadbeds can be determined. In combination with data from Geographic Information Systems (GIS) and Land Information Systems (LIS), roadway and railway survey data can also be used to project future traffic usage, traffic flow patterns, traffic vehicle counts, etc. Comparisons between current survey data and prior data also allow for short term and long term projections as to the frequency required for resurfacing or replacement of the roadways and railways so that the proper load bearing capacity of their roadbeds is maintained to meet anticipated traffic loads.

Currently, mechanical and visual methods are used for performing maintenance surveys on paved roadways and railways. These methods have remained unchanged for many years and involve the use of non-motorized external devices, or dollies, which require another vehicle to propel it and a mechanically activated pointer. These pointers visually indicate a deviation tolerance on a target which must be identified by a field technician. Thereafter, the field technician must manually record the data in a field book and physically mark the roadbed with a paint mark. The disadvantage of such measurement systems is that they are inefficient and time consuming, they require two vehicles and at least two field technicians, they are subject to mechanical errors and breakdowns, they rely on human visual perception of mechanically indicated physical deviations, they require much post-collection analysis by office staff, and they usually require a second trip to the field to confirm data. Maintenance surveys on unpaved roadways are even less precise, generally involving a visual inventory by state or local government field personnel and followed by a scheduling of grading and maintenance based upon the visual inventory.

Most current maintenance systems do not lend themselves readily to the hand generation of an electronic file through keyboard data entry. None of the current maintenance systems allows for the production of an electronic data file that can be stored, recalled, reviewed or analyzed in a computer generated graphical environment (CADD) system. Further, should the current maintenance systems require computer files of survey data, data must be entered manually by traditional keyboard methods from field notes and verbal information provided by the field technicians. Two disadvantages of manual data entry are that it is time consuming and also that it is subject to human error.

Another disadvantage of the prior art is that it leads to disputes between roadway paving contractors and those responsible for maintenance programs. Disputes involve the quantity of material actually used in a resurfacing or reconstruction project. Payment to the paving contractor is usually based on the unit price per ton of asphalt. Maintenance program survey data are used to estimate quantities of construction materials needed for a resurfacing or reconstruction project. Estimated figures are given to the paving contractor, who must either accept the figures or supply other data to refute the accuracy of the survey based estimates. Since surveys by prior art methods are time consuming and expensive, most contractors will not do their own surveys. Instead they resort to random pavement corings, taken after the new pavement is in place, to determine the quantity of material used. Although pavement corings provide accurate depths of material consumed for the immediate surrounding paving, they may not provide a true overall estimate of the quantity of material consumed for completion of the entire paving project.

SUMMARY OF INVENTION—OBJECTS AND ADVANTAGES

A primary object of the present invention is to overcome all of the above-mentioned disadvantages of the prior art and to further meet the immediate need, as well as future anticipated needs, for production of electronic roadway and railway files which may be integrated into an existing municipal Geographic Information System (GIS) or Land Information System (LIS) base map. It is also an object of the present invention that the raw data be converted into corrected X, Y, Z electronic files that are recognizable by most computer generated graphical environment (CADD) system software. It is a further object of the present invention to provide electronic recording of the horizontal location simultaneously with the profiling of the vertical elevations for both roadways and railways. Another object of the present invention is to provide a method and apparatus for the collection of raw data and the production of electronic roadway and railway files which eliminate most of the human error factors found in prior art in the gathering, recording, storing and processing of the raw data.

The present invention overcomes the disadvantages of prior art by combining the use of Global Positioning System (GPS) and automated physical horizontal and vertical location techniques with the automated collection process of ground elevations through the use of non-mechanical distance sensors and a computerized means of gathering, recording, storing and processing the raw data. The invention may be mounted within a conventional vehicle, such as an automobile or van. Conventional railroad high rail gear may be attached to the vehicle for railway applications. A sensor bar is attached to the vehicle perpendicular to its direction of movement either in the front or back of the vehicle. The sensor bar contains a number of non-mechanical distance sensors and two Global Positioning System (GPS) receivers, all of which are connected by a wiring harness to on-board computer means. A digital video camera, also connected to the on-board computer means by a wiring harness, is mounted on the vehicle to record a visual image corresponding to the digital image transmitted by the distance sensors.

The method of using the apparatus of the present invention involves driving the vehicle containing the apparatus to the beginning of a location project. Prior to commencement of data collection, the computer is initialized, after which the vehicle is driven along the roadway or railway surface to be surveyed and combined signals from the distance sensors and GPS receivers are received, stored and categorized by the on-board computer means as raw digital data. An advantage of the present invention is that only one field technician is needed to initialize the apparatus and drive the vehicle along the roadway or railway. Another advantage is that no human error is introduced into the survey data through the transcription of raw data, nor is human error introduced by manual conversion of data into computer files using traditional keyboard data entry methods. Collected data is taken to an office and downloaded into an office computer means for conversion, compilation and translation by proprietary and copyrighted software. The software converts raw data into corrected X, Y, Z electronic files that are recognizable by most current Geographic Information System (GIS) and Land Information System (LIS) software, as well as most current computer generated graphical environment (CADD) system software.

The above description provides preferred embodiments of the present invention but should not be construed as limiting the scope of the Digi-Track Digital Roadway and Railway Analyzer invention. Variations in the number of distance sensors, the mounting position of the sensor bar and the length of the sensor bar, other than those shown, can be incorporated into the present invention. Also, the present invention may be adapted to measure the horizontal and vertical profile of any surface from any type of vehicle, even from aircraft. It also is not critical whether the vehicle or craft is self-propelled. Thus the scope of the present invention should be determined by the appended claims and their legal equivalents, rather than the examples given.

BRIEF DESCRIPTION OF THE DRAWINGS

The sole drawing FIGURE is a perspective view of the invention as it is attached to a vehicle and ready for use.

DETAILED DESCRIPTION OF PREFERRED EMBODIMENTS

The sole drawing figure shows preferred embodiments of the present invention in which two signal receiving Global Positioning System (GPS) units A are attached to opposite ends of a sensor bar B. In one preferred embodiment, sensor bar B may have a length of four meters and be mounted at the front of a vehicle V, at a height of approximately one meter above the roadway surface. Nine ultrasonic distance sensors C mounted on sensor bar B may be positioned so that they will measure the distance to the roadway surface at right angles to the roadway surface. In the preferred embodiment, each distance sensor C is calibrated to measure an approximate one-third meter coverage of the roadway surface, giving full coverage along the length of sensor bar B. However, depending upon the application, the number of distance sensors C, the mounting position of sensor bar B and the length of sensor bar B may vary widely.

Sensor bar B may be attached to either the front or the rear of vehicle V. It is contemplated that sensor bar B may be attached with two conventional receiver style trailer hitches (not shown) so that when not in use, sensor bar B may be removed from vehicle V. Means for attachment of sensor bar B is not critical, however, and other styles of mounting hitches may be used.

For roadway use, a varying number of ultra-sonic or infrared distance sensors C may be attached to sensor bar B. For railway applications, it is contemplated that four ultra-sonic distance sensors C would be used. Two ultra-sonic distance sensors C would be strategically attached to sensor bar B so that one ultra-sonic distance sensor C recorded vertical data over each railway track. The other two ultra-sonic distance sensors C would be placed on sensor bar El at right angles to the track for collection of horizontal data on each railway track. Distance sensors C and GPS units A are connected to onboard computer D by wiring harness E. A user-defined, calibrated distance measuring device F attached to vehicle V sends a magnetic or mechanical trigger signal to computer D to initialize the data collection process. A curb feeler G may also be attached to vehicle V for use as a visual sight reference for the field technician driving vehicle V. In roadway applications, curb feeler G has a guide wheel W at one end. In railway applications, guide wheel W would not be required.

At the beginning of a data collection survey for a roadway surface, distance sensors C and video camera H are initialized. As the data collection survey commences, distance measuring device F sends a trigger signal to initialize computer D. The field technician then uses curb feeler G as a sight reference to guide vehicle V along a pavement seam, while digital information is transmitted by GPS units A and distance sensors C to computer D at predefined stationing intervals along the roadway surface. Concurrent with the recording of the digital information, video camera H records a visual picture of the roadway surface. The visual record allows editing of the database for erroneous data which may have occurred as a result of a physical obstruction such as a fragment of a blown tire casing or an animal carcass. The visual record also allows for correlation and confirmation of the electronic profile files. An interrupt button I connected to computer D allows the field technician to manually and momentarily interrupt signals to computer D from distance sensors C to avoid digitizing of information from physical obstructions. During the data collection survey, deviations in roadway or railway elevation that exceed a user-defined amount cab be automatically marked on the edge of the roadway or railway with a paint spot applied by paint nozzle assembly J attached to vehicle V. A signal from on-board computer D automatically triggers paint nozzle assembly J. After the data collection survey is completed, the digitized information collected is transferred from on-board computer D to office computer L through either a data transfer cord K or via a conventional computer floppy disk (not shown). Office computer L then translates the collected data into electronic files of horizontal and vertical information through the use of proprietary and copyrighted software (not shown). The electronic database files are then stored for future comparison against newly collected survey data.

What is claimed is:

1. A roadway and railway analyzer comprising, a vehicle capable of moving through a predetermined distance; a sensor bar attached to said vehicle in a position perpendicular to the intended direction of movement of said vehicle, said sensor bar having opposite ends; a pair of Global Positioning System (GPS) signal receiving units, each of said GPS signal receiving units attached to one of said opposite ends of said sensor bar; a plurality of non-mechanical distance sensors attached to said sensor bar between said GPS signal receiving units, each of said distance sensors mounted on said sensor bar perpendicular to the surface on which said vehicle will travel during data collection; a distance measuring device for measuring the distance traveled by said vehicle during data collection, said distance measuring device being attached to said vehicle and in contact with the surface upon which said vehicle will travel during data collection; data collection and storage means to which each of said GPS signal receiving units, each of said distance sensors, and said distance measuring device is electrically connected; means to analyze data and compute therefrom the horizontal locations and vertical elevations of roadways and railways, and translate such location and elevation information into formats usable with Geographical Information Systems (GIS) and Land Information Systems (LIS); means to electrically connect each of said GPS signal receiving units, each of said distance sensors, and said distance measuring device to said data collection and storage means; means to attach each of said GPS signal receiving units and each of said distance sensors to said sensor bar; and means to attach said distance measuring device to said vehicle.

2. The roadway and railway analyzer of claim 1 further comprising means for collection of video information attached to said vehicle.

3. The roadway and railway analyzer of claim 1 further comprising conventional railroad high rail gear attached to said vehicle and means to attach said conventional railroad high rail gear to said vehicle so as to allow analysis of railways wherein said plurality of non-mechanical distance sensors comprises four of said non-mechanical distance sensors with two of said non-mechanical distance sensors attached to said sensor bar so that one of said non-mechanical distance sensors is positioned to record vertical information over each railway track and wherein the other two of said non-mechanical distance sensors are attached to said sensor bar so that each non-mechanical distance sensor is positioned perpendicular to one of railway tracks to record horizontal information on each railway track.

4. The roadway and railway analyzer of claim 1 wherein said data collection and storage means to which each of said GPS signal receiving units, each of said distance sensors and said distance measuring device is connected comprises an on-board computer means located on-board said vehicle.

5. The roadway and railway analyzer of claim 1 wherein said means to analyze data and compute therefrom horizontal locations and vertical elevations of roadways and railways comprises a computer means capable of determining longitudinal and transverse elevational profiles in an X, Y, Z, format.

6. The roadway and railway analyzer of 1 claim further comprising an interrupt button connected to said means for data collection and storage so as to allow collection of data only from roadways or railway and not from obstructions located upon said roadways and said railways.

7. The roadway and railway analyzer of claim 1 wherein said means to connect each of said GPS signal receiving units, each of said distance sensors and said distance measuring device comprises a wiring harness.

8. The roadway and railway analyzer of claim 1 wherein said vehicle has a rear portion and further comprising a paint nozzle assembly attached to said rear portion, a quantity of paint housed within said paint nozzle assembly, means to connect said point nozzle assembly to said means for collection and storage of data so that said means for collection and storage of data may automatically trigger said paint nozzle assembly to spray portions of said quantity of paint onto said roadway and said railway in response to collected data exceeding preset minimum and maximum limits.

9. The roadway and railway analyzer of claim 1 further comprising a visual sight reference attached to said vehicle and means to attach said visual sight reference to said vehicle so as to allow an operator of said vehicle to be guided along said roadway or said railway during data collection.

10. A roadway and railway analyzer comprising, a vehicle capable of moving through a predetermined distance; a sensor bar attached to said vehicle in a position perpendicular to intended direction of movement of said vehicle, said sensor bar having opposite ends; a pair of Global Positioning System (GPS) signal receiving units, each of said GPS signal receiving units attached to one of said opposite ends of said sensor bar; a plurality of non-mechanical distance sensors attached to said sensor bar between said GPS signal receiving units, each of said distance sensors mounted on said sensor bar perpendicular to said travel surface; a distance measuring device capable of measuring the distance traveled by said vehicle during data collection, said distance measuring device being attached to said vehicle and in contact with the surface upon which said vehicle will travel during data collection; on-board computer means located on-board said vehicle for collection and storage of data collected by each of said GPS signal receiving units, each of said distance sensors, and said distance measuring device; additional computer means for analysis of collected data and for computing therefrom horizontal locations and vertical elevations of roadways and railways, and for translation of location and elevation information into formats usable with Geographical Information Systems (GIS) and Land Information Systems (LIS), said computer means being capable of determining longitudinal and transverse elevational profiles in an X, Y, Z coordinate format; said roadway and railway analyzer further comprising a wiring harness for electrically connecting each of said GPS signal receiving units, each of said distance sensors, and said distance measuring device to said on-board computer means; means to attach each of said GPS signal receiving units and each of said distance sensors to said sensor bar; and means to attach said distance measuring device to said vehicle.

11. The roadway and railway analyzer of claim 10 further comprising conventional railroad high rail gear attached to said vehicle and means to attach said conventional railroad high rail gear to said vehicle so as to allow analysis of railways, wherein said plurality of non-mechanical distance sensors comprises four of said non-mechanical distance sensors with two of said non-mechanical distance sensors attached to said sensor bar so that one of said non-mechanical distance sensors is positioned to record vertical information over each railway track and wherein the other two of said non-mechanical distance sensors are attached to said sensor bar so that each non-mechanical distance sensor is positioned perpendicular to one of railway tracks to record horizontal information on each railway track.

12. The roadway and railway analyzer of claim 10 further comprising an interrupt button connected to said on-board computer means so as to allow collection of data only from roadways or railways and not from obstructions located upon said roadways or said railways.

13. The roadway and railway analyzer of claim 10 wherein said vehicle has a rear portion and further comprising a paint nozzle assembly attached to said rear portion, a quantity of paint housed within said paint nozzle assembly, means to attach said paint nozzle assembly to said rear portion, and means to connect said paint nozzle assembly to said on-board computer so that said on-board computer may automatically trigger said paint nozzle assembly to spray portions of said quantity of paint onto said roadway and said railway in response to collected data exceeding preset minimum and maximum limits.

14. The roadway and railway analyzer of claim 10 further comprising a visual sight reference attached to said vehicle and means to attach said visual sight reference to said vehicle so as to allow an operator of said vehicle to be guided along said roadway or said railway during data collection.

15. A method for analyzing roadways and railways comprising the steps of, providing a vehicle, a plurality of Global Positioning System (GPS) signal receiving units, a plurality of non-mechanical distance sensors, a distance measuring device, means for collection and storage of data, means to analyze data, means to compute from collected data the horizontal locations and vertical elevations of roadways and railways, and means to translate collected data into formats usable with Geographical Information Systems (GIS) and Land Information Systems (LIS), as well as providing electrically connection means to electrically connect said means for collection and storage of data to each of said GPS signal receiving units, each of said distance sensors and said distance measuring device; mounting each of said GPS signal receiving units, each of said distance sensors and said distance measuring device onto said vehicle; using said electrical connection means to electrically connect each of said GPS signal receiving units, each of said distance sensors and said distance measuring device to said means for collection and storage of data; initializing each of said GPS signal receiving units and each of said distance sensors prior to the start of data collection; beginning to move said vehicle through a predetermined distance; concurrent with the start of vehicle movement, initializing said means for collection and storage of data; establishing a predefined interval for transmission of digital information from each of said GPS signal receiving units, each of said distance sensors, and said distance measuring device to said means for collection and storage of data; transmitting digital information at predefined intervals from each of said GPS signal receiving units, each of said distance sensors and said distance measuring device to said means for collection and storage of data; analyzing data and computing therefrom horizontal locations and vertical elevations of roadways and railways; translating said horizontal locations and vertical elevations into formats usable with Geographical Information Systems (GIS) and Land Information Systems (LIS); and comparing said formats with available Geographical Information Systems (GIS) and Land Information Systems (LIS) to project present and future traffic counts and traffic flow patterns.

16. The method of analyzing roadways and railways of claim 15 further comprising the steps of; providing visual recording means; and concurrent with the transmitting of digital information at predefined intervals from each of said GPS signal receiving units, each of said distance sensors and said distance measuring device to said means for collection and storage of data, recording visual information from the surface upon which said vehicle travels during data collection.

17. The method of analyzing roadways and railways of claim 15 further comprising the steps of providing conventional railroad high rail gear and gear attachment means for attaching said conventional railroad high rail gear to said vehicle; and attaching said conventional railroad high rail gear to said vehicle with said gear attachment means to allow analysis of railways; and wherein said providing of a plurality of non-mechanical distance sensors comprises providing four of said non-mechanical distance sensors with two of said non-mechanical distance sensors being attached to said sensor bar so that one of said non-mechanical distance sensors is positioned to record vertical information over each railway track, and wherein the other two of said non-mechanical distance sensors is attached to said sensor bar so that each non-mechanical distance sensor is positioned perpendicular to one of the railway tracks to record horizontal information thereon.

18. The method of analyzing roadways and railways of claim 15 further comprising the steps of providing a paint nozzle assembly, paint nozzle attachment means to attach said paint nozzle assembly to said vehicle, and electrical connection means to connect said paint nozzle assembly to said means for collection and storage of data; attaching said paint nozzle assembly to the rear portion of said vehicle with said paint nozzle attachment means; and electrically connecting said paint nozzle assembly to said means for collection and storage of data with said electrical connection means so that said means for collection and storage of data can automatically trigger said paint nozzle assembly to spray portions of paint onto said roadway or railway when collected data exceeds preset maximum and minimum values.

19. The method of analyzing roadways and railways of claim 18 further comprising the steps of providing an interrupt button and electrical connection means to connect said interrupt button to said means for collection and storage of data; and connecting said interrupt button to said means for collection and storage of data with said electrical connection means so that said means for collection and storage of data can be manually interrupted by an operator when collected data exceeds preset maximum and minimum values.

* * * * *